United States Patent [19]

Witherden

[11] Patent Number: 4,558,563

[45] Date of Patent: Dec. 17, 1985

[54] STRANDING MACHINES

[75] Inventor: Alan Witherden, Gravesend, England

[73] Assignee: Cortinovis S.p.A., Bergamo, Italy

[21] Appl. No.: 628,442

[22] Filed: Jul. 6, 1984

[30] Foreign Application Priority Data

Jul. 12, 1983 [GB] United Kingdom ..... 8318814

[51] Int. Cl.[4] ..... D07B 7/00; D01H 9/00

[52] U.S. Cl. ..... 57/266; 57/270; 57/314; 242/25 R; 242/35.5 A

[58] Field of Search ..... 57/266, 314, 267, 268, 57/270, 276, 58.3–58.38; 242/25 R, 18 R, 35.5 A

[56] References Cited

U.S. PATENT DOCUMENTS

| | | | |
|---|---|---|---|
| 3,360,915 | 1/1968 | Franzen | 57/266 X |
| 3,429,115 | 2/1969 | Purdy et al. | 57/266 |
| 3,468,115 | 9/1969 | Goodfellow et al. | 57/266 |
| 3,563,020 | 2/1971 | Harris et al. | 57/266 |
| 4,157,792 | 6/1979 | Wyckhuys | 242/25 A |
| 4,298,171 | 11/1981 | Fluckiger et al. | 242/18 A |

FOREIGN PATENT DOCUMENTS

| | | |
|---|---|---|
| 2176973 | 11/1973 | France . |
| 2472532 | 7/1981 | France . |

*Primary Examiner*—John Petrakes

*Attorney, Agent, or Firm*—Sherman & Shalloway

[57] ABSTRACT

A device for use in loading a rotary stranding machine of the so-called fork construction comprises an L-shaped loading platform located laterally adjacent to the stranding machine to receive wire supply bobbins resting thereon. The loading platform is mounted for rectilinear upward sliding movement upon mountings which are in turn mounted for pivoting movement about a horizontal axis parallel to the rotary axis of the stranding machine. A jacking means is linked between a fixed anchorage and a part of the loading platform spaced from the horizontal pivotal axis whereby upon extension of the jacking means the loading platform is first tilted about the horizontal axis and then moved rectilinearly to bring the ends of the bobbin into alignment with loading pintles of the stranding machine.

7 Claims, 8 Drawing Figures

STRANDING MACHINES

BACKGROUND OF THE INVENTION

This invention concerns improvements in and relating to stranding machines such as are utilised for the production of wire ropes, electrical cables, or the like. More particularly, the invention relates to an improved mechanism for use in loading and unloading the wire supply bobbins to be installed in a wire stranding machine.

In the operation of a wire stranding machine, the productivity that may be obtained from the machine is determined not only by the speed at which the machine itself can be run, but by the time required for loading and unloading the wire supply bobbins to be installed in the machine, during which time the machine is at a standstill. In machines incorporating a large number of relatively heavy wire supply bobbins, the time required for changing bobbins to reload the machine has occupied a relatively large proportion of the operating cycle of the machine, and thus a variety of attempts have been made to reduce the loading time in these machines.

The requirement for easy access to the stranding machine to facilitate loading has led to the development of the so-called fork type stranding machine, wherein bobbins disposed in groups spaced along the rotary axis of the machine are mounted in a manner such that the bobbins of each group are held in fork-shaped trunnions extending radially from the rotary axis of the machine. This enables the simultaneous replacement of a plurality of bobbins utilising a cradle arranged to receive a row of bobbins extending axially of the machine. By indexing the machine into a predetermined angular position wherein one bobbin of each of the relatively axially spaced groups within the machine is located in a predetermined, common radial position with respect to the rotary axis of the machine, simultaneous replacement of the bobbins can be effected by moving a corresponding cradle radially towards and away from the rotary axis of the machine to engage, remove and replace the bobbins.

The annular position from which the bobbins are removed and replaced is determined by the selected method of handling the cradles containing bobbins. In one previously proposed arrangement, bobbins are inserted and removed from a point vertically above the axis of the machine, utilising an appropriate mechanical crane. In another arrangement, bobbins are inserted and replaced along a horizontal axis utilising a fork lift truck. In yet another proposed arrangement bobbins may be inserted and removed from vertically below the rotary axis of the machine, utilising an elevating platform installed directly below the machine.

All of the above proposed arrangements have significant drawbacks. When using a crane or fork lift truck to handle bobbins or bobbin cradles, the precision with which the bobbins can be located relatively to the machine during installation is a function of human judgement, and thus time is consumed in appropriately indexing the rotary machine and adjusting the positions of the bobbins until they register with the trunnions of the machine. In the case where bobbins are elevated from vertically below the axis of the machine, the procedure is complicated by restricted access to the machine and the difficulty in readily inspecting the installed bobbins at such a position in the machine.

Accordingly, there is a requirement for a more convenient and more rapid arrangement for installing supply bobbins in rotary stranding machines.

SUMMARY OF THE INVENTION

In accordance with the present invention there is provided an arrangement for loading supply bobbins into a stranding machine which is characterized in that an elevator device is arranged to provide a loading platform for receiving supply bobbins at a position laterally adjacent the stranding machine, and that the loading platform is arranged to transfer bobbins from the initial position of the platform to the stranding machine along a path inclined obliquely upwards with respect to the initial position of the loading platform.

Advantageously, the said platform is arranged to undergo a two stage movement wherein the platform is initially tilted about a horizontal axis, and then moved rectilinearly into the desired position within the stranding machine. Accordingly, the said loading platform may conveniently be of generally L-shaped configuration comprising a base member and an upright member extending in mutually perpendicular planes running parallel to the rotary axis of the stranding machine, and the arrangement being such that a bobbin initially loaded upon the base member of said platform becomes supported to an inclined position resting upon the initially upright member of the platform during tilting of the platform prior to rectilinear movement thereof along said inclined path.

In a particularly simple arrangement the said loading platform is mounted for pivoting movement about a first, horizontal axis, and for sliding movement along a second axis perpendicular to said horizontal axis, and an extendable jacking means is pivotally linked between a fixed anchorage and the said loading platform in such a manner that extension and retraction of said jacking means is effective to transmit both the required pivoting and sliding movements to the loading platform.

DETAILED DESCRIPTION OF THE PREFERRED EMBODIMENT

Figure 1:
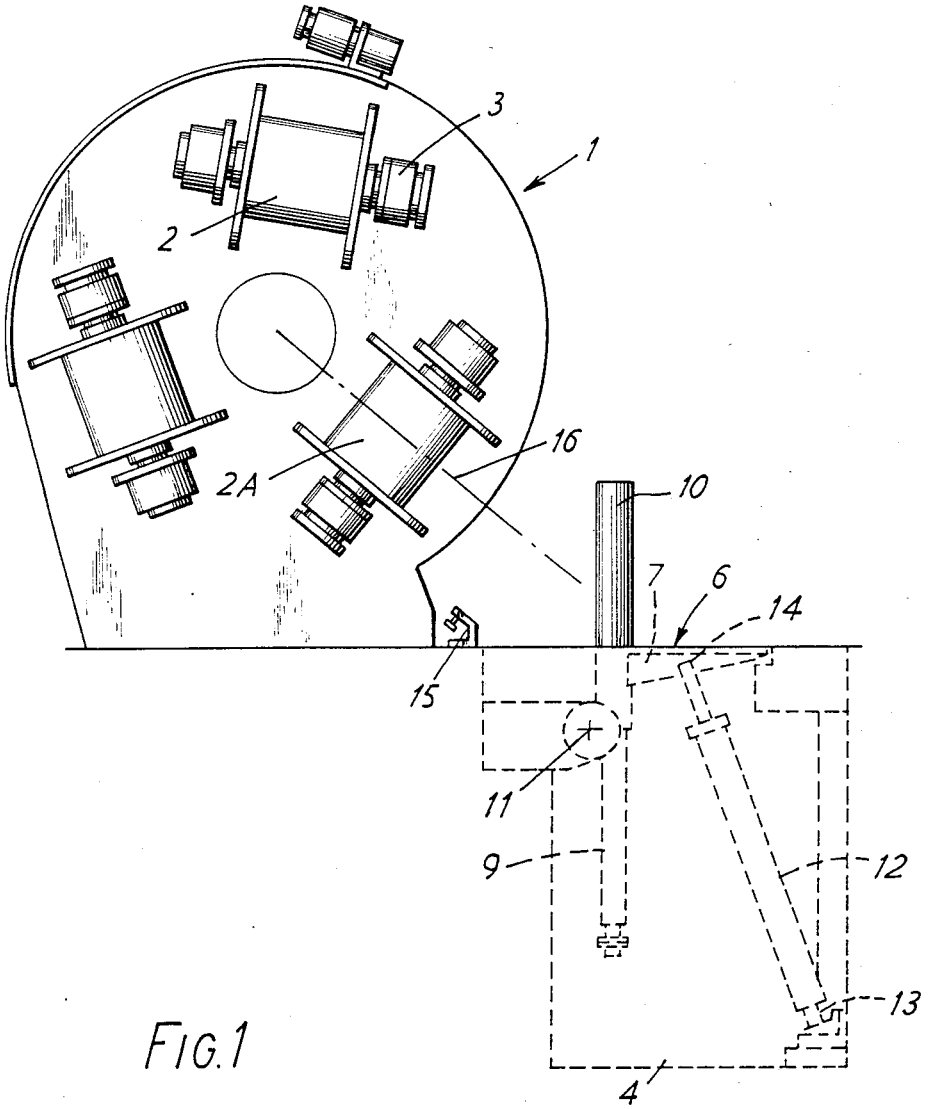
FIGS. 1 to 7 respectively comprise diagrammatic views taken along the rotary axis of a stranding machine and show a loading arrangement in accordance with the invention in various consecutive working positions.

Referring to the drawings, a rotary stranding machine of the so-called fork construction is illustrated diagrammatically at 1. The stranding machine carries a plurality of groups of wire supply bobbins 2 arranged in axial spacing along the rotary axis of the machine, of which one group of three bobbins is visible in the drawings. The machine is of generally known type and will not therefore be described in further detail, and it will suffice to say that each of the bobbins 2 is located in loading pintles 3 which can be automatically actuated to engage and release the supply bobbin, for example by means of a pneumatic actuating arrangement. The pintles 3 are held in fork-shaped trunnions extending radially from the rotary axis of the machine, such trunnions being omitted from the drawings for clarity.

Figure 3:
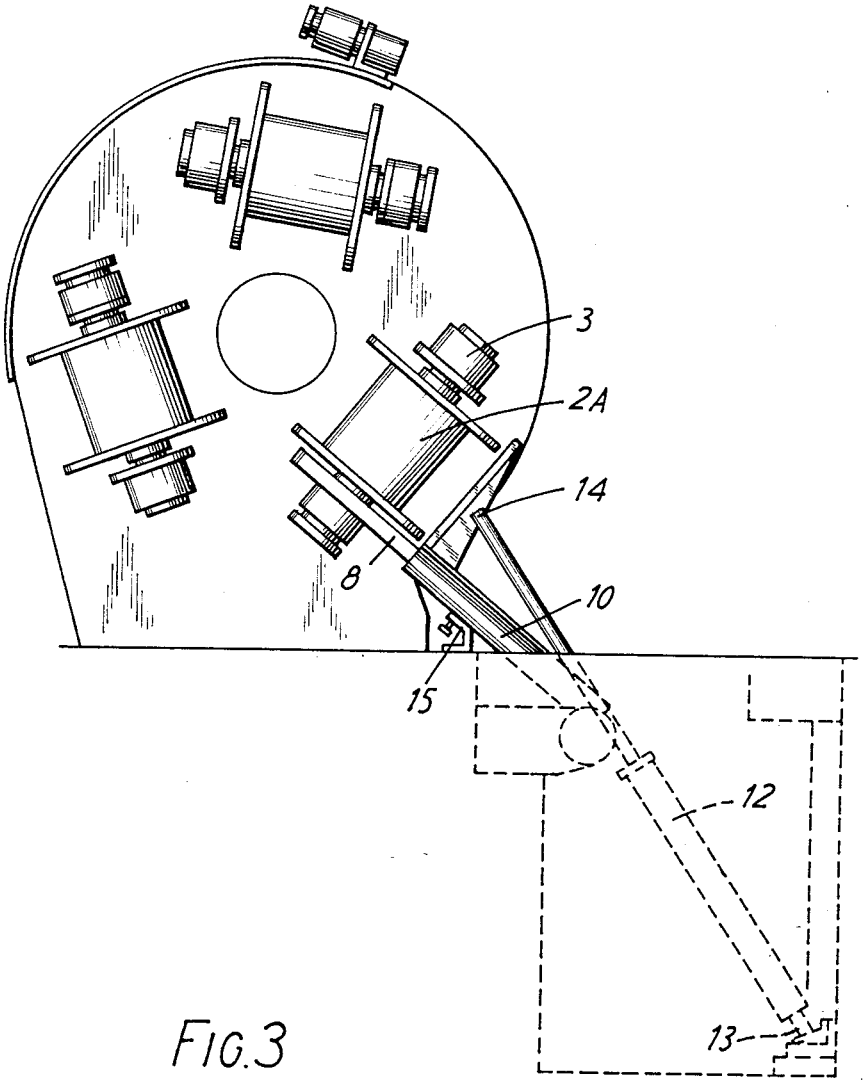
Figure 4:
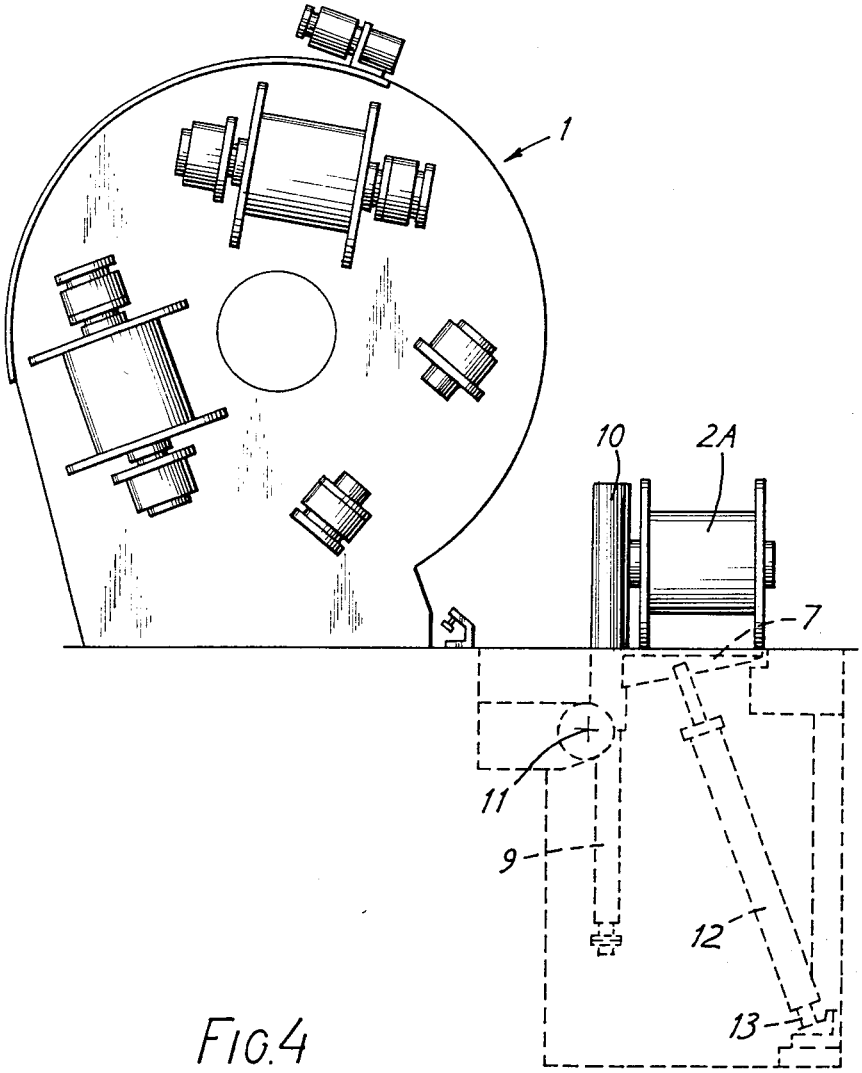

An elevator device in accordance with one embodiment of the invention is located within a pit 4 below the surface of the floor 5 upon which the stranding machine is installed, and in the rest condition shown in FIG. 1 is arranged to present a loading surface 6 extending generally flush with the surface of the floor. The loading surface 6 is provided by a platform element 7 which forms one arm of a generally L-shaped angle member, of which the other arm 8 (see FIG. 3) extends vertically upright along one side of the surface 6, when the device is in the position of FIG. 1. The angle member 7,8, is supported on a plurality of shafts 9 which are mounted for rectilinear sliding movement in corresponding locating pillars 10. The pillars 10 are in turn mounted for pivoting movement about a horizontal axis 11 extending generally parallel to the rotary axis of the stranding machine 1. A jacking means for elevating the platform provided by the angle member 7,8, is formed by a plurality of hydraulic rams 12 pivotally linked in each case between a fixed mounting 13 and a linkage 14 on the platform member 7. Upon extension of the hydraulic rams 12, firstly the pillars 10 are caused to pivot about the axis 11 until restrained by engagement with corresponding adjustable stop members 15, and secondly the angle member 7,8, is lifted with respect to the pillars 10, being slidingly guided by way of shaft 9.

Figure 2:
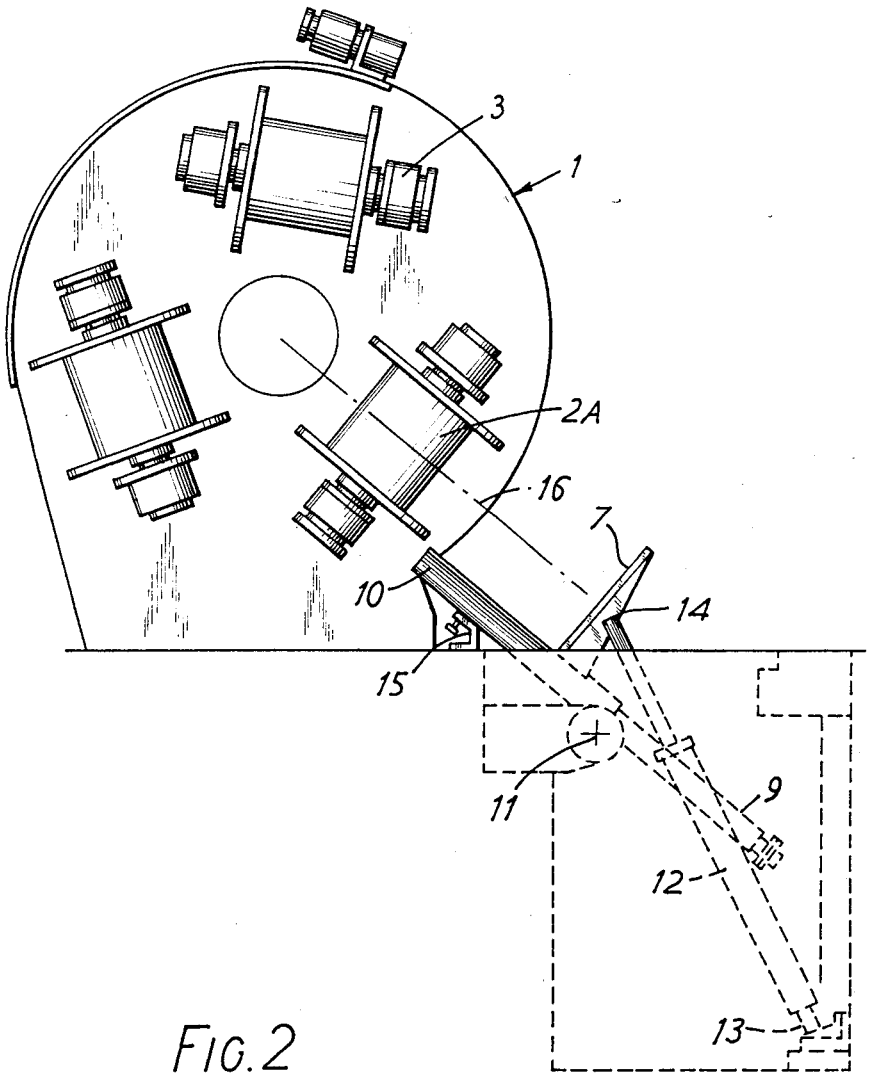

By means of the simple arrangement illustrated the bobbins of the stranding machine 1 can be rapidly and reliably unloaded and reloaded in the following manner. Starting from the position shown in FIG. 1, wherein the loading device is in an idle condition and the bobbins 2 are in an empty, or substantially empty condition and require to be replaced, the stranding machine 1 is indexed into a predetermined angular position wherein one bobbin 2A of the group illustrated is located with its median plane upon a predetermined radius 16 with respect to the rotary axis of the machine. Such indexing may be effected in two stages, for example by bringing the bobbin 2A initially into approximate alignment with the radius 16 utilising the main motor of the stranding machine, and then finally indexing the machine to bring the bobbin into accurate alignment, by means of a secondary motor for fine adjustment of the rotary position of the machine. The machine is then securely braked in the position of alignment, by means of an appropriate mechanical interlocking device not illustrated in the drawings. The hydraulic rams 12 are then extended to cause pivoting of the pillars 10 into the position shown in FIG. 2, wherein the axes of the pillars 10 are exactly parallel with the radius 16 as determined by the adjustable stops 15. Continued extension of the hydraulic rams 12 now causes the shafts 9 to slide within the pillars 10 until the base member 7 is brought into contact with the rims of the bobbin end flanges and the upright member 8 lies alongside the lowermost end flanges of the bobbins 2A, with a slight spacing therebetween. When the device has reached the position shown in FIG. 3, the automatic pintle release is operated in order to free the bobbin 2A from its mounting pintles, so that the bobbin is supported solely upon the members 7,8, of the platform element.

Figure 6:
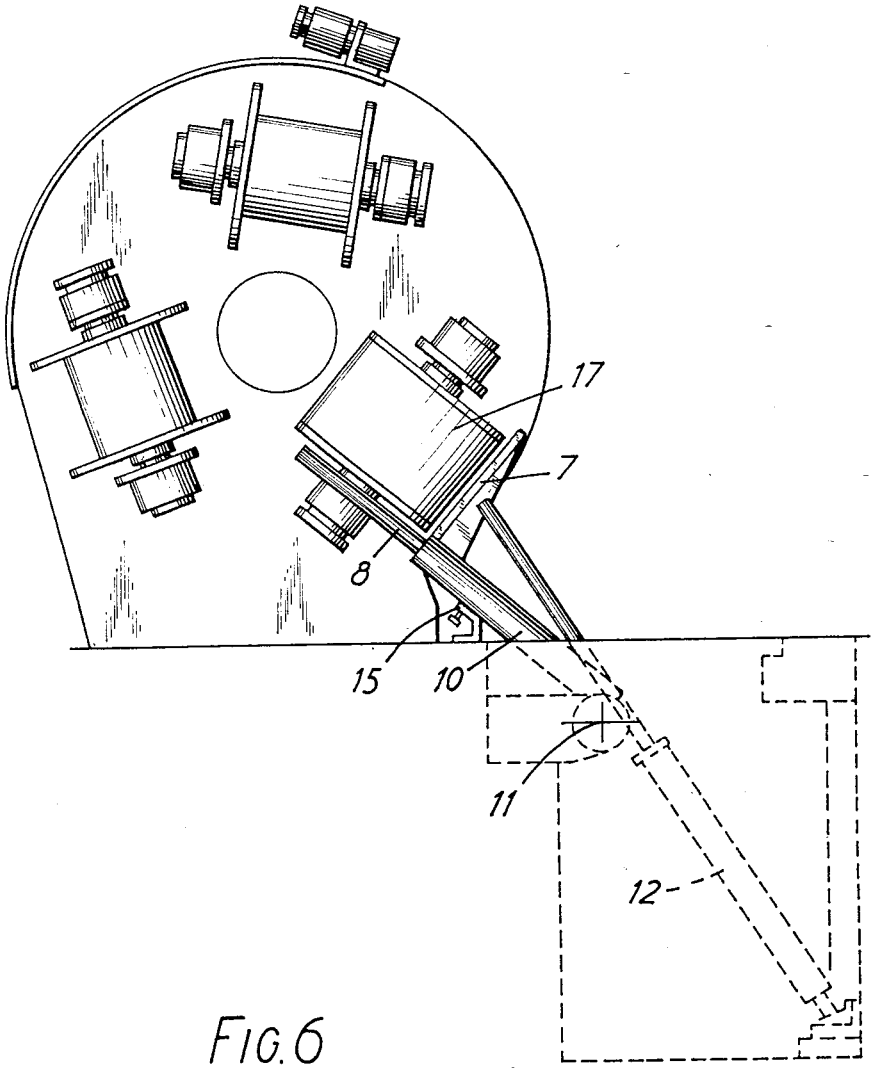
Figure 7:
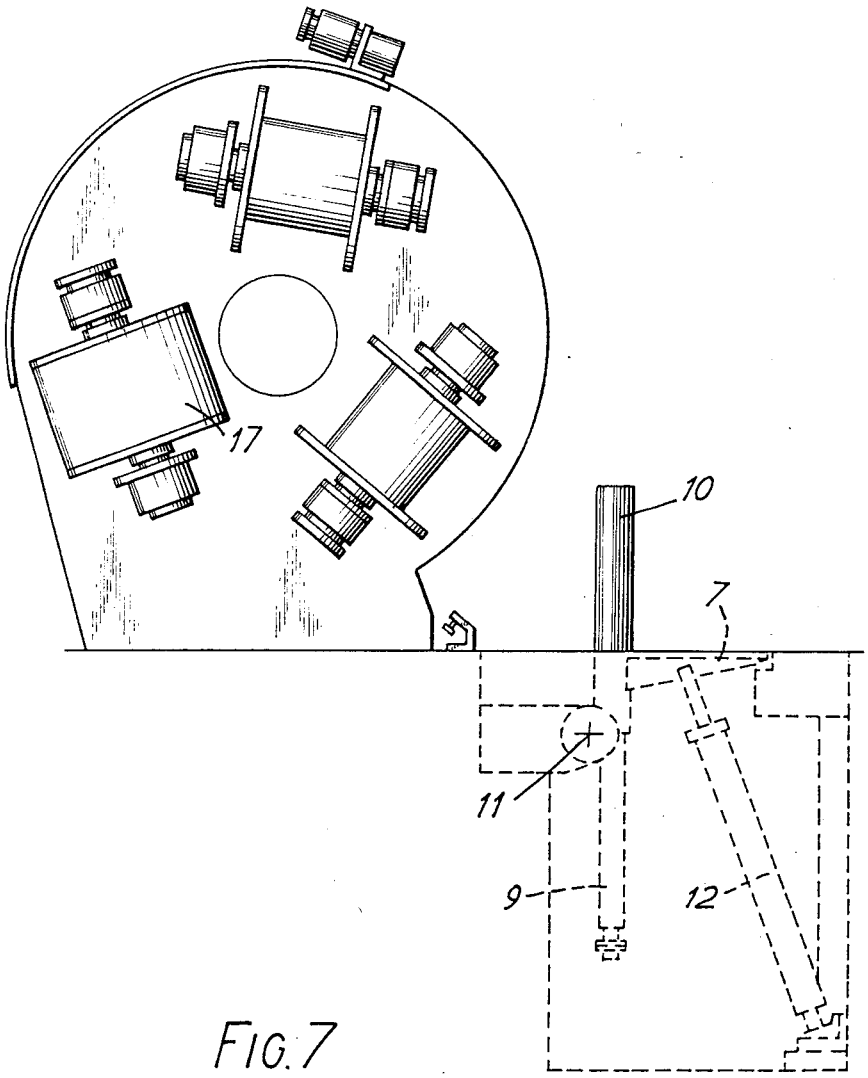
Figure 8:
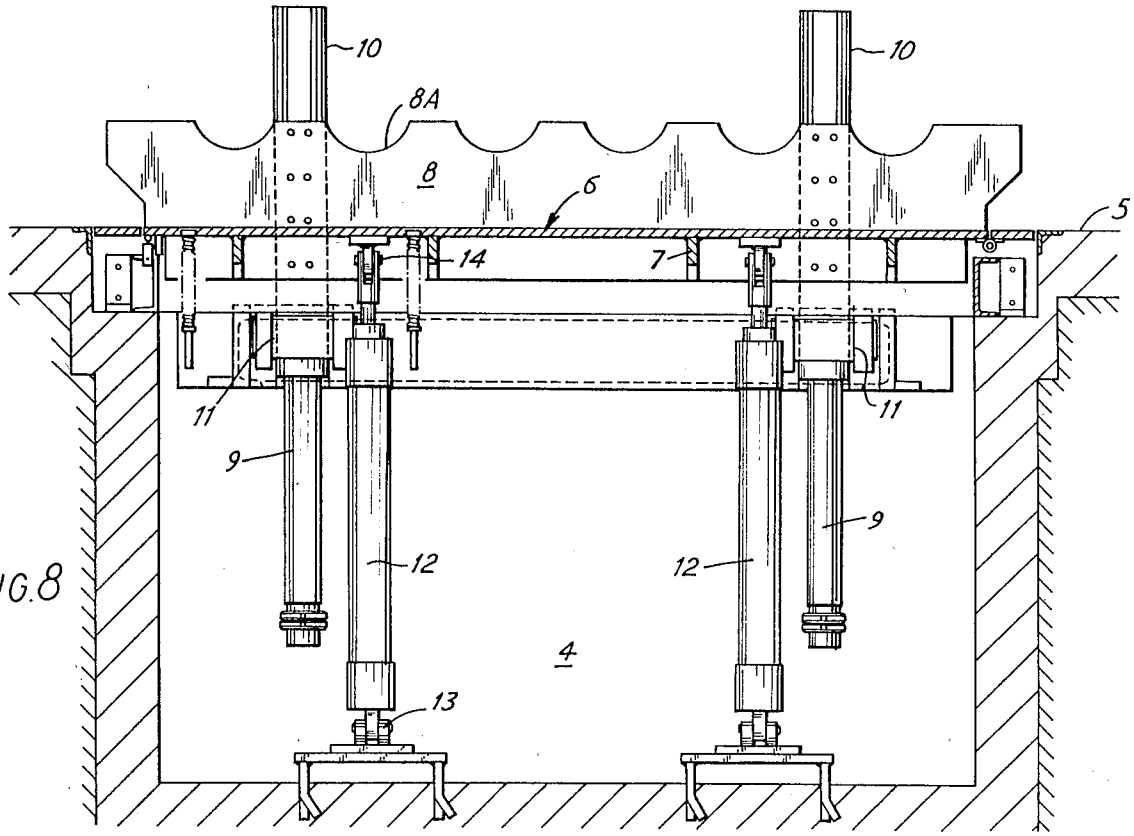
FIG. 8 is a side view of the loading arrangement.

Although the platform element is illustrated in FIGS. 1–7 of the drawings in relationship to only one bobbin 2A, it will be seen from FIG. 8 that the platform element extends along the longitudinal axis of the machine, and thus can simultaneously receive a number of bobbins located in the same angular alignment as the bobbin 2A illustrated. FIG. 8 also shows that the upper edge of the member 8 is provided with vertically extending recesses or notches to accommodate the bobbin mounting pintles 3.

By now retracting the hydraulic rams 12, the platform element 7,8, is returned to its starting position, wherein the bobbin or bobbins 2A rest upon their end flanges on the platform element 7, and may be conveniently rolled away to a discharge point.

Figure 5:
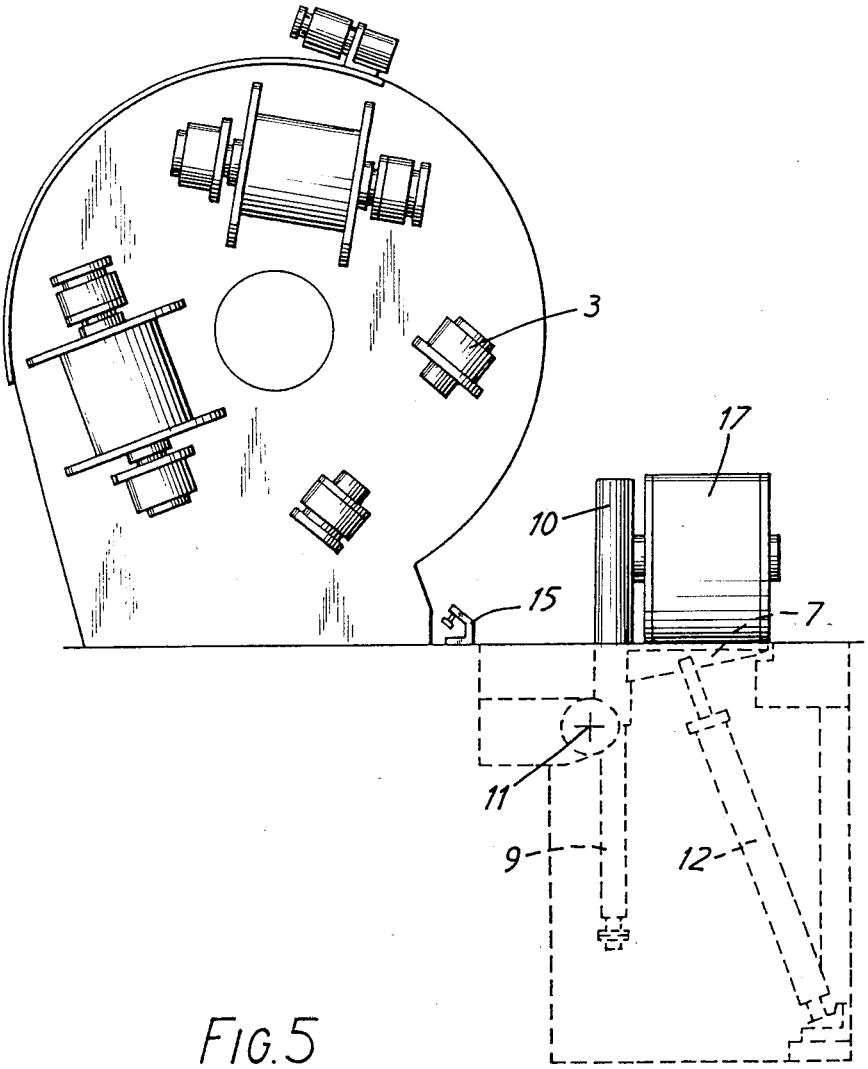

Reloading of the stranding machine with full supply bobbins can now be effected by a reversal of the above procedure, as illustrated in FIGS. 5 and 6. The reloading process can be effected very simply by rolling replacement bobbins 17 onto the platform element 7, and the longitudinal positions of the respective bobbins with reference to the stranding machine may be determined, for example, by means of small locating recesses provided in the platform 7 for engaging and retaining the rims of the bobbin end flanges.

After completion of the unloading and reloading process illustrated in FIGS. 1 to 6, the stranding machine 1 may be indexed into a further angular position, as shown in FIG. 7, at which the complete unloading and reloading cycle may be repeated for the next row of empty bobbins.

It will be appreciated that the arrangement described above provides an extremely simple and convenient means for the replacement of supply bobbins in a stranding machine. Since the elevator device is located laterally adjacent the stranding machine there is ease of access for operatives to remove and replace bobbins located on the loading platform 7, and since all cooperating parts of the loading device and the stranding machine may be accurately adjusted in predetermined relationship and mechanically interlocked, there is a minimum requirement for the exercise of human judgement, whereby the respective steps of the loading and reloading procedure may be effected more quickly. In addition, safety interlocks may be arranged to prevent actuation of the device otherwise than in the correct sequence, or in the event of a fault, for example in the operation of the automatic bobbin pintles.

Whilst the above description has been made by way of example of one embodiment of the invention, it will be appreciated that various modifications and alterations may be made to the arrangement illustrated without departing from the scope of the invention as initially outlined above. For example, although primarily intended for use with fork-type stranding machines, an arrangement operating on the principle of the invention may be applied to any other suitable type of stranding machine. Variations to the form of the bobbin loading platform and the mechanical elevator arrangement may also be apparent to those skilled in the art.

I claim:

1. A device for use in loading supply bobbins into a stranding machine of the kind having a generally horizontal rotary axis and arranged to carry bobbins between loading pintles with rotary axes of said bobbins disposed tangentially to a circle generated by a radius from the rotary axis of the stranding machine, comprising a loading platform arranged for location at a position laterally adjacent to the stranding machine at or near floor level in order to receive bobbins to be loaded therein with their rotary axes disposed horizontally and transverse with respect to the rotary axis of the stranding machine, and an elevator device arranged to transmit to said loading platform a two-stage movement wherein the platform is initially tilted about a horizontal axis to bring the axis of a bobbin carried by said platform into a position oblique to the rotary axis of the stranding machine and is then moved rectilinearly along a path inclined obliquely upwards and radial to the rotary axis of the stranding machine to a position wherein the supply bobbin or bobbins supported thereon are located in position for engagement with the loading pintles of the stranding machine.

2. A device as claimed in claim 1, wherein the said loading platform is of generally L-shaped configuration, comprising a base member and an upright member extending in mutually perpendicular planes running parallel to the rotary axis of the stranding machine, whereby a bobbin initially loaded upon the base member of said platform becomes supported in an inclined position resting upon the initially upright member of the platform as a result of said tilting movement of the platform about said horizontal axis.

3. A device as claimed in claim 2, wherein the said loading platform is mounted for pivoting movement about said horizontal axis, and for sliding movement along a second axis perpendicular to said horizontal axis, and the said elevator device comprises an extendable jacking means pivotally linked between a fixed anchorage and a point on said loading platform spaced from said horizontal axis in such a manner that extension and retraction of said jacking means is effective to transmit both tilting and rectilinear movements to the loading platform.

4. A device as claimed in claim 3, wherein said loading platform is guided for rectilinear sliding movement by mountings which are in turn pivoted for tilting movement about said horizontal axis.

5. A device as claimed in claim 4, wherein the said loading platform is fixed to a pair of spaced upright shafts slidingly received in corresponding pillars provided by said mountings.

6. A device as claimed in claim 1, wherein the said loading platform is so arranged that when in the loading position it presents a horizontal support surface extending flush with an adjacent floor surface located at ground level whereby bobbins resting on their end flanges can be rolled from said floor surface onto the support surface of the loading platform.

7. A device as claimed in claim 6, wherein said loading platform is provided with locating recesses for engagement by the rims of the bobbin end flanges, whereby the bobbin or bobbins become located in a predetermined loading position.

* * * * *